US005359956A

United States Patent [19]

Lee

[11] Patent Number: 5,359,956

[45] Date of Patent: Nov. 1, 1994

[54] STEERING SYSTEM FOR HIGH PERFORMANCE POWERBOATS

[76] Inventor: Richard D. Lee, 934 Tyner, Incline Village, Nev. 89451

[21] Appl. No.: 188,655

[22] Filed: Jan. 28, 1994

Related U.S. Application Data

[63] Continuation of Ser. No. 858,794, Mar. 27, 1992, abandoned.

[51] Int. Cl.[5] ..... B63H 25/38

[52] U.S. Cl. ..... 114/163; 114/162

[58] Field of Search ..... 114/163, 162, 152, 129, 114/164

[56] References Cited

U.S. PATENT DOCUMENTS

| | | | |
|---|---|---|---|
| 5,162 | 6/1847 | Shermer | 114/163 |
| 31,845 | 3/1861 | Winans | 114/163 |
| 421,008 | 2/1890 | Martin | 114/129 |
| 1,529,036 | 3/1925 | Richey | 114/163 |
| 1,682,815 | 9/1928 | Vincent | 114/163 |
| 1,916,597 | 7/1933 | Witte | 114/162 |
| 2,972,324 | 2/1961 | Williams | 114/163 |
| 3,206,998 | 9/1965 | Matz et al. | 114/144 R |
| 3,249,081 | 5/1966 | Schuster | 114/152 |
| 3,407,774 | 10/1968 | Burke | 114/163 |
| 3,774,568 | 11/1973 | Borst et al. | 114/144 R |
| 4,263,866 | 4/1981 | Shirley | 114/56 |
| 4,561,370 | 12/1985 | Sanford | 114/163 |

FOREIGN PATENT DOCUMENTS

| | | | |
|---|---|---|---|
| 191499 | 8/1986 | Japan | 114/163 |
| 327385 | 4/1930 | United Kingdom | 114/163 |

*Primary Examiner*—Michael S. Huppert
*Assistant Examiner*—Thomas J. Brahan
*Attorney, Agent, or Firm*—Fulwider Patton Lee & Utecht

[57] ABSTRACT

A steering system for a high performance powerboat includes a secondary rudder which is located along the hull of the boat forward to the main aft rudder. An actuator is attached to the main rudder of the boat to effect rotation of the rudder about its axis of rotation for steering purposes. A second actuator operative with the actuator of the main rudder effects rotation of the secondary ruddercounter to the rotation of the main rudder.

9 Claims, 2 Drawing Sheets

STEERING SYSTEM FOR HIGH PERFORMANCE POWERBOATS

This application is a continuation of application Ser. No. 07/858,794, filed Mar. 27, 1992, now abandoned.

BACKGROUND OF THE INVENTION

1. Field of the Invention

The present invention relates generally to systems for steering motorboats and, more particularly, to a steering system for a high performance powerboat which utilizes a secondary, fin-like rudder located forward to the main, aft rudder for providing improved steering and stabilizing capabilities to the boat, especially during sharp, high speed turns or when the boat is towing a water-skier.

2. Description of Related Art

Powerboats are available in numerous shapes and sizes and can have varying hull constructions along with different propulsion systems. There are two basic types of hull designs for powerboats, namely displacement and planing hulls, with many variations of the planing hulls. Displacement boats are characterized as vessels that cruise through water while planing boats are designed to lift a part of the hull out of the water to skim the surface of the water. Planing boats have become increasingly popular and are used in activities which require high speed performance, such waterskiing and powerboat racing.

There are also different types of propulsion systems to choose from which differ in the manner in which the engine is placed on the boat and the power that can be generated. For example, an inboard system, in which the engine is mounted within the hull of the boat, and an outboard system, in which the engine is mounted on a transom of the boat and is detachable, are two widely used propulsion systems for powerboats. Another type of system, called a stern-drive system and sometimes referred to as an inboard-outboard, I-O, or outdrive system, utilizes an engine mounted inside the hull of the boat with a portion of the drive unit, resembling the lower portion of an outboard motor, extending through the transom. All of these types of systems utilize the same basic concept of creating thrust or propulsion through rotation of a propeller which draws water ahead and pushes it astern to propel the boat through water.

Although outboard, stern-drive and inboard systems rely on propeller propulsion to move the boat through the water, the steering systems associated with each propulsion system differs significantly in handling and construction. On an single-screw, inboard powerboat, the shaft and propeller are fixed along the centerline of the hull since the engine is mounted within the hull of the boat. Steering on an inboard powerboat is accomplished through the use of a vertical rudder blade pivoted on a stock and located near the stern of the boat in close proximity to the propeller. Outboard and stern-drive boats, on the other hand, use directed-thrust steering, usually without the help of a rudder, to propel and steer the boat through water.

Powerboats used to tow water-skiers encounter unique handling problems since large forces can be generated by the dynamic action of the water-skier and directly transmitted to the stern of the boat via the towline. The action of the water-skier can generate a large force that can act on the stern of the boat causing it to slip or "kickout" in the general direction of the force causing the boat to deviate from its original direction. When this occurs, the operator of the boat must compensate for the pulling force by quickly turning the steering wheel to straighten the boat out in order to maintain the desired course of travel.

The pull on the stern of the boat is particularly critical when the boat itself is making a turn since the stern of the boat has a natural tendency to kickout somewhat to the side opposite the direction of the turn. Depending upon the position and pull generated by the skier via the towline, the stern of the boat can be pulled out further by the water-skier causing the boat to deviate sharply from its intended line of travel. Again, when this occurs, the operator of the boat must compensate by quickly turning the steering wheel to attempt to straighten out the boat to the desired line of travel.

Competition powerboats are particularly susceptible to the dynamic effects of a towed skier in competition water events such as the slalom. In this particular event, the powerboat pulls the skier through a series of pylons which are set to the left and right of the powerboat which the skier must successfully pass around to complete the event. In some events, the pylons can be as far as forty or more feet laterally from the boat. The motion of the water-skier quickly goes from one side of the boat to the other as the skier attempts to successfully negotiate and pass each pylon. The speed of the skier is quite fast as he/she moves from one pylon across to the next in a matter of seconds. As a result of this speed, the pulling force acting on the stern of the boat rapidly changes both magnitude and direction as the skier passes from one side of the boat to the other.

During the slalom event, the powerboat must steer a straight course through a channel defined by another set of pylons while the skier is in tow. Due to the speed of the water-skier passing from one side of the boat to the other, the dynamic force generated by the skier can cause a tremendous pulling on the stern which can cause the boat to veer from its straight line course through the pylons. Therefore, the driver must constantly compensate for the pulling forces on the stern since the slalom is a high speed and high performance event of limited duration. The operator generally does this by trying to simultaneously watch the motion of the skier while looking forward to stay within the pylons.

Therefore, there is a need for a steering system which allows a powerboat to successfully tow a water-skier and compensates for the dynamic effect of the towed skier on the boat. Such a system should compensate for the directional control problems caused by the pulling force on the boat both when a straight line course is being followed or when the boat enters into a turn. Additionally, such a steering system would also be beneficial if it allows powerboats to negotiate tighter, high speed turns without loss of speed.

SUMMARY OF THE INVENTION

The present invention overcomes the above mentioned shortcomings by providing a steering system for high performance powerboats which enhances the steering characteristics of the boat, especially when the boat is towing a water-skier. The present invention helps compensate for the dynamic effects of the towed skier on the stern of the powerboat as the water-skier moves from one side of the boat to the other. The present invention helps compensate for the pull of the skier and corrects the directional control problems associated with waterskiing. The invention also helps reduce lateral sliding or yawing which can occur from the pull of the skier which is transmitted the boat via the towline. Also, the invention can provide improved steering and stabilization capabilities to the boat during sharp, high speed turning.

The present invention utilizes a secondary, fin-like rudder located along the centerline of the boat's hull and forward to the main rudder for improving the steering capability of the boat. This secondary rudder is substantially vertical to the hull and is pivotally affixed to the hull to rotate about an axis in the same manner as the main rudder. The fin-like rudder is operative with the main rudder such that the secondary rudder is rotated in an opposite direction to any rotation of the main rudder, i.e., when the main rudder is rotated clockwise, the secondary rudder rotates counter clockwise, and visa versa. In this manner, the plane of the secondary rudder creates resistance (drag) in the water to help steer and maintain the boat on its original course and compensate against the pulling force exerted on the stern of the boat by the dynamic action of a water-skier. This secondary rudder can act in combination with a pair of stationary lateral stabilizing fins that can be also mounted to the hull along the centerline of the boat directly behind the secondary, fin-like rudder. These stabilizing fins are not moveable but can provide additional lateral stability to the boat.

The steering system includes actuating means for moving or rotating the main rudder and secondary rudder simultaneously. In one preferred embodiment of the invention, actuating cables can be attached to one arm of a two arm lever that is mounted to a stock of the main rudder. The actuating cable can then be attached to the steering wheel of the boat to allow the rudder to be moved as needed. A second actuating cable can be attached to the second arm of the two arm lever and attached to a lever arm mounted on the secondary rudder to rotate it whenever the main rudder is rotated. albeit in an opposite rotation.

Other features and advantages of the present invention will become apparent from the following detailed description, taken in conjunction with the accompanying drawings, which illustrate, by way of example, the principals of the present invention.

DETAILED DESCRIPTION OF THE PREFERRED EMBODIMENTS

Figure 1:
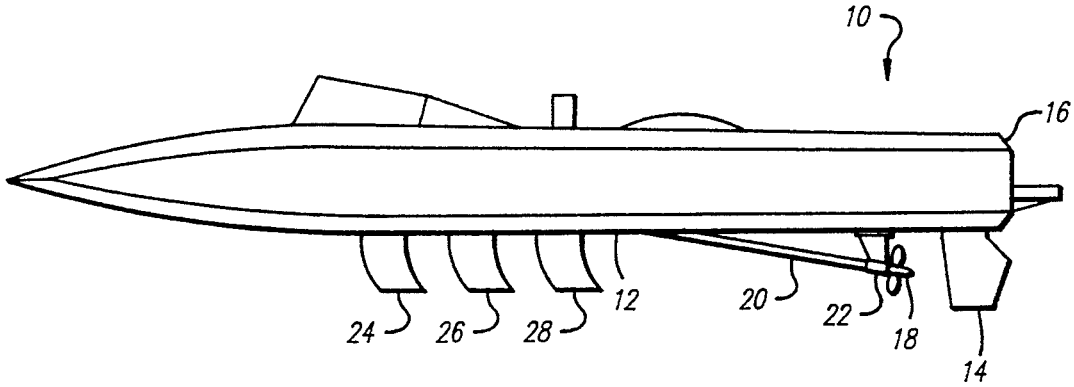
FIG. 1 is a side elevational view of a high performance inboard powerboat embodying the present invention.

As shown in the exemplary drawings, the present invention is shown in FIG. 1 as it is embodied on a high performance inboard powerboat 10. The boat 10 has a hull 12 which has a vertical main rudder 14 (after referred to as an aft rudder) located at its stern 16 which is pivotally mounted thereto so that the movement of the steering wheel of the boat rotates the rudder about its axis of rotation to steer the boat either to port or starboard. As can be seen in FIG. 1, a propeller 18 attached to the end of a propeller shaft 20 extends from the hull 12 of the boat to which it is attached to the inboard mounted engine (not shown) located in the hull of the boat. A strut 22 is attached to the hull and supports the exposed propeller shaft 20.

A secondary fin-like rudder 24 extends from the hull and is attached to a stock (not shown) which allows the rudder 24 to rotate about its fixed axis of rotation. The stock extends into the hull of the boat where it is attached to actuating means which moves the fin-like rudder whenever the main rudder 14 is moved. A pair of stationary lateral-stabilizing fins 26 and 28 are shown directly behind this fin-like rudder 24 and are attached along the centerline of the hull. These particular fins 22 and 28 help provide additional stabilization to the boat as it makes sharp high speed turns and help reduce lateral movement (yawing) of the boat during a turn or when the pulling force transmitted to the boat by a water-skier becomes too great.

Figure 2:
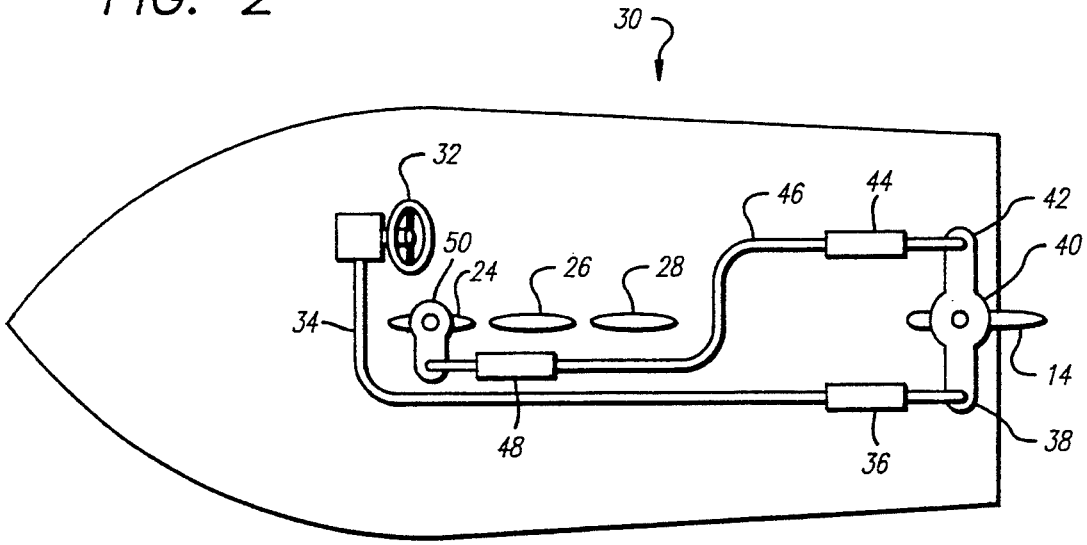
FIG. 2 is a diagram showing the outline of a boat and the general layout of the main rudder, the secondary, fin-like rudder, the lateral stabilizing fins and one particular embodiment for effecting the steering of the boat through the rotation of the main and secondary rudders.

Referring now to-FIG. 2, a diagram showing an outline of a boat 30 and the general arrangements of elements making up one embodiment of the present invention can now be discussed to explain the basic principals of the present invention. In FIG. 2, the main rudder 14 is shown as it would be substantially positioned near the stern of the boat which is shown by the outline of the boat. The fin-like rudder 24 is also shown as it would be relatively positioned along the centerline of the boat. The lateral stabilizing fins 26 and 28 are in position directly behind the fin-like rudder 24. It should be appreciated that this secondary rudder 24 and other stabilizing fins 26 and 28 must remain in the water even when the bow of the boat begins to plane during high speed operation. As a result, the particular position of this secondary rudder may vary on different sized boats depending upon such variables as the length of the boat and the length of boat that remains in the water during high speeds. Accordingly, if the secondary rudder is placed too far forward on the boat such that it is also raised partially out of the water during operation, its effect on the steering of the boat will be drastically reduced.

Means for manually steering the boat, such as the steering wheel 32 shown in FIG. 2, is connected to actuating means 34, such as a Morse cable, which has one end 36 attached to an arm 38 of a two-arm lever 40 that is mounted to the stock of the main rudder to rotate the rudder when a turn is desired. The second arm 42 of the lever 40 is in turn attached to the end 44 of another actuating means 46, again a Morse cable, which has its other end 48 attached to a lever 50 that is mounted to and is utilized to rotate the fin-like rudder 24 whenever the main rudder is rotated via the steering wheel 32. The Morse cables would, of course, be clamped to the hull (not shown in FIG. 2) to operate properly.

In operation, the fin rudder 24 is designed to be moved in an opposite direction to the movement of the main rudder. As the angle of the main rudder is increased to make a sharp turn, the angle of the secondary rudder is also increased which tends to reduce the amount of lateral movement of the boat resulting from a turn or from the pulling force generated by a skier and helps reduce the kickout of the stern. The other lateral stabilizing fins cooperate with the secondary rudder to achieve these results.

Figure 3:
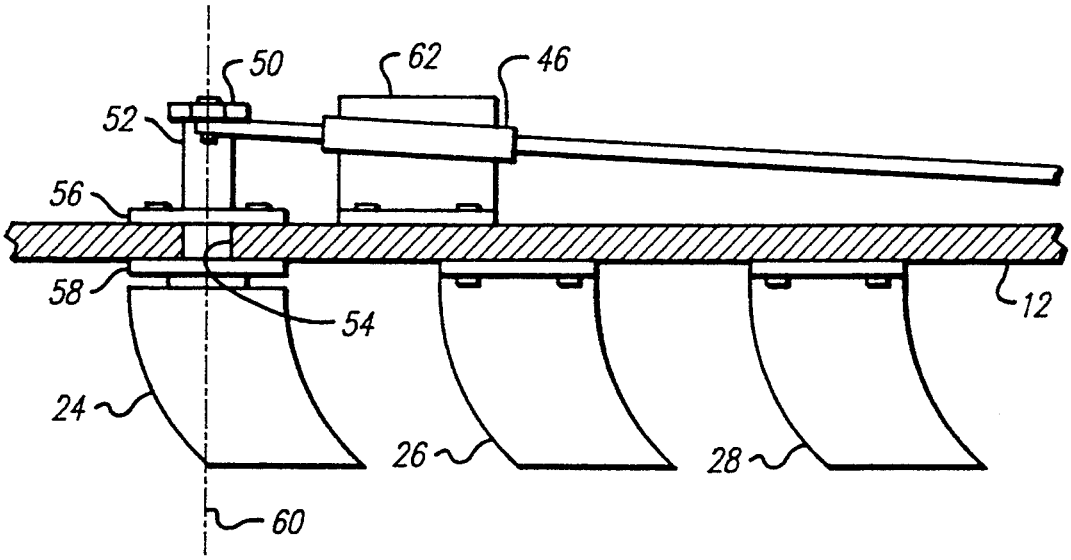
FIG. 3 is a partial cross-sectional view showing the secondary fin-like rudder attached to the hull of the boat and the actuating mechanism.

FIG. 3 shows a partial cross-sectional view of the fin-like rudder 24 as it is attached to the hull. The fin-like rudder 24 is attached to a stock (not shown), which is surrounded by a stuffing box 52 which extends through an opening 54 in the hull. The stuffing box 52 includes a pair of mounting plates 56 and 58 which are directly mounted to the hull. The stuffing box allows the stock to rotate but prevents water from seeping in to the hull through the opening. A lever 50 such as the one shown in FIG. 2 is mounted to the stock and is in turn attached to an actuator which moves the lever to rotate the rudder about its axis of rotation which is shown by line 60. The actuator, which in this particular embodiment is a Morse cable, must be attached to the boat via a bracket 62 mounted to the hull to effect the turning of the lever. The other end of the cable is attached to the arm of the lever that is mounted on the main rudder. Actuation of the main rudder by the steering wheel of the boat does simultaneously actuates the rotation of this secondary fin-like rudder.

Figure 4:
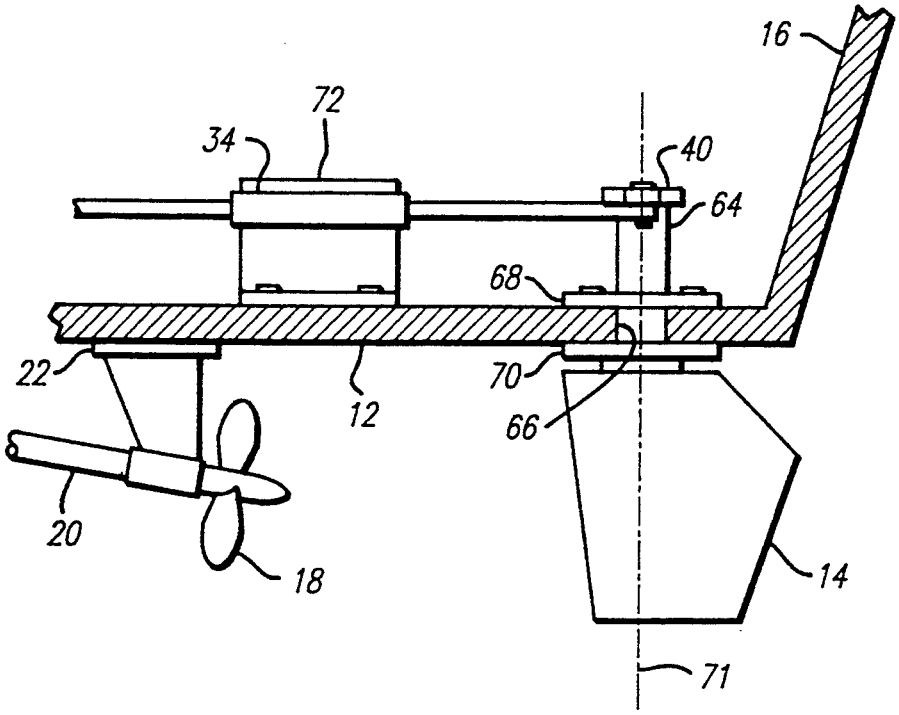
FIG. 4 is a partial cross-sectional view showing the secondary fin-like rudder attached to the hull of the boat and the actuating mechanism.

Referring now to FIG. 4, the main rudder is shown as it is affixed to the hull of the boat. This particular rudder is also attached to a stock (not shown) which is surrounded by a stuffing box 64 that extends through an opening 66 in the hull. This stuffing box also includes a pair of mounting plates 68 and 70 which are directly mounted to the hull for a water tight seal. As is shown better in FIG. 2, the stock of the rudder includes a two-arm lever 40 which is attached to the actuating means 34. The second actuating means (not shown) is attached to the second arm of the two arm lever and is used to actuate the rotation of the secondary rudder 24. The other cable is directly attached to the steering wheel of the boat to allow the operator to rotate the main rudder about its axis of rotation shown by line 71 as needed. The actuator 34, which again in this particular embodiment is a Morse cable, must be attached to the boat via a bracket 72 mounted to the hull to effect the turning of the lever.

It should be appreciated that any actuating means can be used with the main rudder and the fin-like rudder to rotate them accordingly in accordance with the present invention. In the embodiment shown and described herein, a Morse cable has been utilized to actuate the movement of the rudders; however, any device which can be implemented with the steering wheel of the boat and which can be operatively connected to the respective rudders can also be used without departing from the spirit and scope of the present invention.

The secondary rudder made in accordance with the present invention can be made from a metallic material or similar high-strength material which would not deteriorate during use. It can take on the shape of a fin and can have a foil-like profile which allows water to be streamlined around it when the boat is moving in a straight or substantially straight direction.

The particular size and shape of the secondary rudder and the lateral stabilizing fin will vary from boat to boat depending upon such variables as the length, size and power that can be generated by the boat. As was previously mentioned, the location of the secondary rudder and the stabilizing fins along the boat will depend upon the length of the boat that remains in the water once it starts to plane. Again, if the secondary rudder is raised out of the water due to planning, its effect on the boat's steering capability is diminished. Also, the particular amount that the secondary rudder moves in relation to the rotation of the main rudder can also vary from boat to boat. The particular ratio of the rotation of the main rudder to the rotation of the secondary rudder, i.e. 25 the number of degrees of rotation of the main rudder to the number of degrees rotation of the secondary rudder, can range anywhere from about 1:2 to 3:1. The particular ratio to be used on any given boat can again vary depending upon the size, shape and power generated by the boat. It should also be appreciated that the present invention can operate with just a single secondary rudder without the need for additional lateral stabilizing fins in order to obtain the desired results. This may not be true in all cases and again, the size, number, shape and position of these lateral stabilizing fins can vary from boat to boat.

While the particular powerboat shown and described herein is an inboard powerboat, it should be appreciated that the present invention can also be used on outboard and stern-drive boats as well, since these types of vessels can experience the same directional control problems encountered when towing a water-skier. Likewise, the present invention can be utilized on any powerboat which has directed-thrust steering.

From the foregoing, it will be appreciated that the steering mechanism of the present invention provides improved steering of a boat, especially when the boat is towing a water skier. The secondary rudder and lateral stabilizing fins help prevent lateral slipping of the boat during turns and when the stern is subjected to the forces generated by the water-skier, it also helps stop the stern from kicking out to an unwanted position.

While a particular form of the present invention has been illustrated and described, it would also be apparent that various modifications can be made without departing from the spirit and scope of the present invention and is not intended that the invention be limited, except by the appended claims.

I claim:

1. A steering system for a high performance planing powerboat, comprising:

a main rudder extending from the hull of the powerboat substantially near the stern, said rudder being pivotable about an axis of rotation;

actuating means for rotating said main rudder about its axis of rotation to effect steering of the boat;

a secondary rudder disposed on the centerline of the hull of said boat forward of said main rudder and at a central portion on said boat hull, said secondary rudder being pivotable about an axis of rotation;

actuating means for effecting rotation of said secondary rudder; and at least one stabilizing fin disposed on the centerline of the hull forward of said main rudder and aft of said secondary rudder and spaced closely to said secondary rudder for cooperating with said secondary rudder to reduce lateral slippage of the powerboat during a turn caused by the deflection of said rudders said secondary rudder having a fin-like shape approximating the shape of said stabilizing fin.

2. The steering system of claim 1 wherein said actuating means for effecting rotation of said secondary rudder is operative with said actuating means for rotating said main rudder.

3. The steering system of claim 2 wherein said actuating means for rotating said secondary rudder rotates the secondary rudder counter to the rotation of said main rudder.

4. The steering system of claim 3, wherein said secondary rudder has a foil-like profile which allows water to be streamlined around it when the powerboat is moving in a substantially straight direction.

5. The steering system of claim 1 wherein said actuating means for rotating said main rudder comprises a steering wheel mechanism that can be manually rotated by an operator of the powerboat and a first cable system operative with said steering wheel mechanism, said first cable system being attached to a first lever mounted to said main rudder for moving said first lever, and said actuating means for effecting rotation of said secondary rudder comprises a second cable system operatively attached to said first lever of said main rudder and a second lever mounted to said secondary rudder for effecting movement of said second lever in a direction counter to movement of said first lever in response to movement of said first lever.

6. The steering system of claim 1, further including a second stabilizing fin disposed on a center line of the hull of the powerboat behind said first stabilizing fin.

7. A steering system for a high speed powerboat of the type which includes a planing hull and inboard powerplant, comprising:

a first rudder located in the aft portion of the hull, said first rudder being pivotally mounted to said hull on a first steering post;

a second rudder located forward of said first rudder at a central portion of the longitudinal centerline of the boat hull, said second rudder pivotally mounted to said hull on a second steering post;

at least one fin fixed to the centerline of the boat and extending vertically downward from the hull, said fin located aft of said second rudder and nearer to said second rudder than said first rudder said second rudder having a fin-like shape approximating the shape of said stabilizing fin; at a central portion of said hull; and steering means operative to cause said second rudder to deflect in a direction opposite to said first rudder.

8. A steering system for a high performance planing powerboat having a hull with a bow, a stern, and a centerline, said steering system comprising:

a main rudder extending from the hull of the powerboat substantially near the stern, said main rudder being pivotably about a first axis of rotation;

first actuating means for rotating said main rudder about said first axis of rotation to effect steering of the powerboat;

stabilizing fin means for reducing lateral slippage of the powerboat during a turn, said stabilizing fin means being disposed on the centerline of the hull forward of said main rudder at a central portion of said hull;

a secondary rudder disposed on the centerline of the hull of said powerboat forward of and adjacent to said stabilizing fin, said secondary rudder being pivotable about a second axis of rotation said secondary rudder having a fin-like shape approximating the shape of said stabilizing fin means; and second actuating means for rotating said secondary rudder about said second axis of rotation, said second actuating means being connected to said first actuating means to cause said secondary rudder to rotate about said second axis of rotation in a direction counter to rotation of said main rudder about said first axis of rotation.

9. The steering system of claim 8, wherein said stabilizing fin means comprises at least one stabilizing fin.

* * * * *

UNITED STATES PATENT AND TRADEMARK OFFICE

CERTIFICATE OF CORRECTION

PATENT NO. : 5,359,956

DATED : November 1, 1994

INVENTOR(S) : Richard D. Lee

It is certified that error appears in the above-identified patent and that said Letters Patent is hereby corrected as shown below:

In Column 1, line 29, after "such", insert --as--;

In Column 1, line 53, delete "an", insert --a--;

In Column 3, line 3, after "transmitted", insert --to--;

In Column 3, line 39, after "rotated", insert --,--;

In Column 4, line 25, delete "to-FIG.", insert --to FIG.--;

In Column 5, line 21, delete "does";

In Column 5, line 67, delete "planning", insert --planing--;

In Column 6, line 4, delete "25";

In Column 6, line 28, insert hyphen between "water" and "skier";

In Column 8, line 12, delete "pivotably", insert --pivotable--.

Signed and Sealed this

Twenty-eight Day of February, 1995

*Attest:*

Bruce Lehman

BRUCE LEHMAN

*Attesting Officer*

*Commissioner of Patents and Trademarks*